US007363850B2

(12) United States Patent
Becker

(10) Patent No.: US 7,363,850 B2
(45) Date of Patent: Apr. 29, 2008

(54) DIAPHRAGM PUMP

(75) Inventor: Erich Becker, Bad Krozingen (DE)

(73) Assignee: KNF Neuberger GmbH, Freiburg (DE)

( * ) Notice: Subject to any disclaimer, the term of this patent is extended or adjusted under 35 U.S.C. 154(b) by 283 days.

(21) Appl. No.: 10/541,350

(22) PCT Filed: Feb. 26, 2004

(86) PCT No.: PCT/EP2004/001887

§ 371 (c)(1),
(2), (4) Date: Jul. 5, 2005

(87) PCT Pub. No.: WO2004/083639

PCT Pub. Date: Sep. 30, 2004

(65) Prior Publication Data

US 2006/0039806 A1 Feb. 23, 2006

(30) Foreign Application Priority Data

Mar. 22, 2003 (DE) ..... 103 12 899

(51) Int. Cl.
*F16J 3/02* (2006.01)

(52) U.S. Cl. ..... 92/103 F

(58) Field of Classification Search ..... 92/103 F, 92/96

See application file for complete search history.

(56) References Cited

U.S. PATENT DOCUMENTS 3,947,156 A 3/1976 Becker
5,349,896 A 9/1994 Delaney, III et al.
5,564,911 A 10/1996 Santa
5,699,717 A 12/1997 Riedlinger
6,655,257 B1 12/2003 Meyer

FOREIGN PATENT DOCUMENTS

DE 198 34 468 2/2000
EP 1 219 833 7/2002

*Primary Examiner*—F. Daniel Lopez
(74) *Attorney, Agent, or Firm*—Volpe and Koenig, P.C.

(57) ABSTRACT

The invention relates to a diaphragm pump (1) including a working diaphragm (3) that, during pumping movements, oscillates between a bottom dead center and a top dead center. The working diaphragm (3) delimits a pump chamber (7) between itself and a concave pump chamber wall (6) and when located at the top dead center position, the working diaphragm (3) rests against the pump chamber wall (6). The working diaphragm (3) has an inner and an outer annular zone (8, 9), which can be deformed during pumping movements, and a stiffened diaphragm area which, in essence, cannot be deformed during pumping movements is placed between these annular zones (8, 9). This non-deformable diaphragm area can be stiffened, for example, by stiffening ribs (10), which are radially oriented and spaced apart in the circumferential direction. The working diaphragm (3) neither tends to increase the total chamber volume nor reduce the suction chamber volume, even in the event of differences in pressure loads occurring between the upper side and the lower side of the diaphragm.

8 Claims, 2 Drawing Sheets

DIAPHRAGM PUMP

BACKGROUND

The invention relates to a diaphragm pump comprising a working diaphragm that, during pumping movements, oscillates between a bottom dead center and a top dead center. The working diaphragm delimits a pump chamber between itself and a preferably concave pump chamber wall and when located at the top dead center position, the working diaphragm rests against the pump chamber wall.

Diaphragm pumps of the type named above are already known in various configurations. If such diaphragm pumps are operated in the lower vacuum range, there is the risk that the working diaphragm will bulge due to differences in the pressure loads occurring between the top side and the lower side of the diaphragm and therefore will reduce the suction chamber volume. Even in this lower vacuum range, large pressure differences occur between the top side and the lower side of the diaphragm. While atmospheric pressure usually applies a load on the lower side of the diaphragm, the corresponding evacuation pressure acts on the top side of the diaphragm, wherein the maximum pressure difference is given by the atmospheric pressure minus the limiting pressure of the diaphragm pump.

In typical diaphragms of conventional diaphragm pumps, especially when these diaphragm pumps operate within the range of the limiting pressure and large differences in pressure loads are applied to the diaphragms, it is to be emphasized that the lateral, elastic zone of the flexible diaphragm bulges in the direction towards the feeding chamber due to the atmospheric pressure. This "bulging" of the diaphragm leads to the result that the suction chamber volume is reduced considerably, which has a negative effect on the suction capacity of diaphragm pumps.

This change in shape is especially pronounced in two-stage and multi-stage diaphragm pumps with low limiting pressures. In these pumps, the lowest vacuum stage is affected the most, because the greatest pressure differences occur here.

From, WO 00/49293, a membrane pump with a working membrane made of an elastic material is already known, which has in a strengthened central area for a connection for a connecting rod head and an outer area with a clamping rim for connection to the pump head. On the pump chamber defining upper side of the membrane, a number of circumferentially extending ribs are provided that are spaced apart from one another radially outwardly from the strengthened central area of the membrane, which provide a higher strength for the membrane against pressure while retaining the flexibility of the central area bordering the outer ring zone of the membrane.

With the help of the upper membrane side of the known membrane provided with ribs, it is possible for a cracking of the membrane upper side-, a bulging of the membrane between the clamping rim and the central area in the provided flexible ring zone is not prevented in any case by the circumferentially oriented ribs.

SUMMARY

Therefore, the objective arises of designing a diaphragm pump of the above-noted type, which, even in the event of differences in pressure loads occurring between the top side and the lower side of the diaphragm, tends neither to increase the total chamber volume nor to reduce the suction chamber volume.

According to the invention, the solution to meeting this objective for the diaphragm pump of the above-noted type, is provided by the characteristics of claim 1.

The diaphragm pump according to the invention has a working diaphragm, which has an inner and an outer annular zone, wherein a stiffened diaphragm area, which cannot be deformed during the pumping movements, is placed between these annular zones. While the inner and the outer annular zone form two hinge areas, which permit the bending of the working diaphragm required by the stroke in these areas, the non-deformable diaphragm area lying in-between acts against an undesired and performance-reducing bulging of the working diaphragm at increased differences in pressure loads. Here, the diaphragm is stiffened in its non-deformable diaphragm area, such that the working diaphragm nevertheless rests unimpaired against the preferably concave pump chamber wall at the top dead center.

The working diaphragm is stiffened in its non-deformable diaphragm area by means of support ribs, which are oriented in the radial direction, which are spaced apart from each other in the circumferential direction, and which are arranged on the lower side of the diaphragm facing away from the pump chamber wall. The working diaphragm of the diaphragm pump according to the invention, which has such stiffening support ribs on the lower side of its diaphragm facing away from the pump chamber wall, can be formed at least in its non-deformable diaphragm area from a single material layer. In this way, the support or stiffening ribs are embodied geometrically and dimensioned, such that, for example, even for low limiting pressures, the atmospheric pressure prevailing during the suction stroke on the lower side of the diaphragm, cannot bend the diaphragm in its non-deformable diaphragm area. The support ribs stiffening this diaphragm area are delimited on both sides by the deformable annular zones, which form the hinge areas required for the flexing movements of the diaphragm during the pumping movements.

The support ribs can be arranged in the radial direction on the lower side of the diaphragm. However, the greater the angle of the support ribs to the radial lines, the smaller the radial deformation of the support ribs and the deformation of the contours of the ribs facing the compression chamber associated with an increase in the dead space as well as with a reduction of the final vacuum. Here, a refinement according to the invention provides that the support ribs have a curved longitudinal extent and thus are arranged practically in a spiral on the lower side of the diaphragm.

In contrast, if the ribs have a straight longitudinal extent, it can be advantageous if the support ribs deviate from the radial lines preferably up to ±30°.

Here, it is useful if the support ribs spaced apart from each other in the circumferential direction have the same direction of curvature or deviation from the radial lines.

So that a working diaphragm with a uniform thickness in its non-deformable diaphragm area can also rest well especially against the preferably concave pump chamber wall, it is advantageous if the side of the support ribs facing the pump chamber wall is fitted to the contours of the pump chamber wall shape.

Additional features of the invention will be understood from the following description of embodiments according to the invention in connection with the claims as well as the drawing. The individual features can be reduced to practice individually or in combinations for an embodiment according to the invention.

BRIEF DESCRIPTION OF THE DRAWINGS

Shown in schematic representation are.

DETAILED DESCRIPTION OF THE PREFERRED EMBODIMENTS

Figure 2:
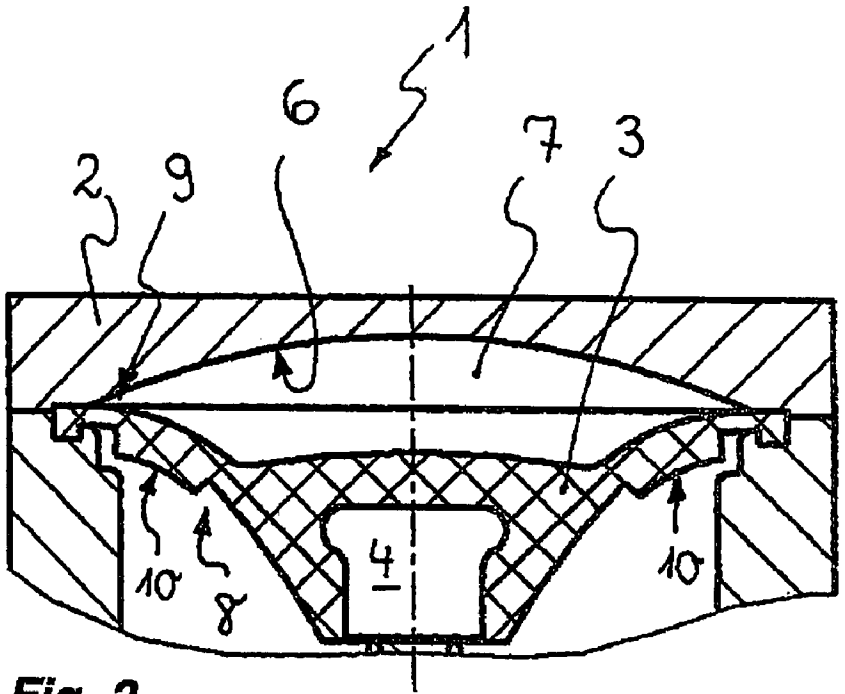
FIG. 2 is a view of the working diaphragm from FIG. 1 at the bottom dead center of its pumping movements, FIG. 3 a lower side view of the diaphragm of a working diaphragm comparable with FIG. 1, and FIG. 4 a lower side view of the working diaphragm from FIGS. 1 to 3 in a modified embodiment.
Figure 1:
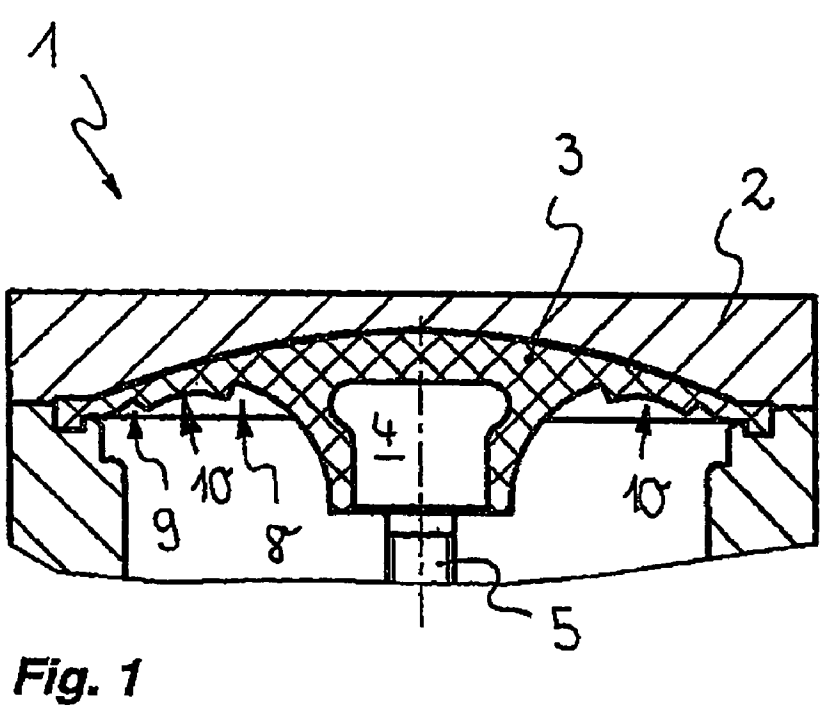
FIG. 1 a view of the working diaphragm of a diaphragm pump at the topr dead center of its pumping movements, wherein the working diaphragm has two annular zones, which act as deformable hinge areas and between which a non-deformable diaphragm area stiffened by means of support ribs is arranged.

In FIGS. 1 and 2, a diaphragm pump 1 is shown in the region of its pump head 2. The diaphragm pump 1 has a working diaphragm 3, which is tensioned at its peripheral edge in the pump head. In the working diaphragm 3, a central attachment core 4 is formed, which is connected to the connecting member 5 of a crank drive not shown in more detail here. The working diaphragm 3 oscillating between the top dead center shown in FIG. 1 and the bottom dead center shown in FIG. 2 during the pumping movements, and delimits a pump chamber 7 between itself and a concave pump chamber wall 6.

Especially if the diaphragm pump 1 shown here, for example, as a fore-pump of a turbo molecular pump, operates in lower vacuum ranges, large pressure differences occur between the top side and the lower side of the diaphragm. So that the working diaphragm 3 does not bulge due to the differences in pressure loads occurring between the top side and the lower side of the diaphragm and so that therefore the suction chamber volume is not reduced significantly, the working diaphragm 3 has a stiffened annular zone that is essentially non-deformable during the pumping movements. This non-deformable diaphragm area is delimited by an inner annular zone 8 and an outer annular zone 9, which are used as deformable hinge areas during the pumping movements.

For stiffening the diaphragm in its non-deformable diaphragm area, there are support ribs 10, which are oriented here in the radial direction and which are arranged on the lower side of the diaphragm facing away from the pump chamber wall 6. These support ribs 10 are spaced apart from each other at uniform intervals in the circumferential direction. So that the working diaphragm 3—as FIG. 1 shows—can rest against the pump chamber wall 6 preferably over its entire surface in the top dead center, the side of the support ribs 10 facing the pump chamber wall 6 is adapted in shape to the contours of the pump chamber wall 6.

Figure 3:
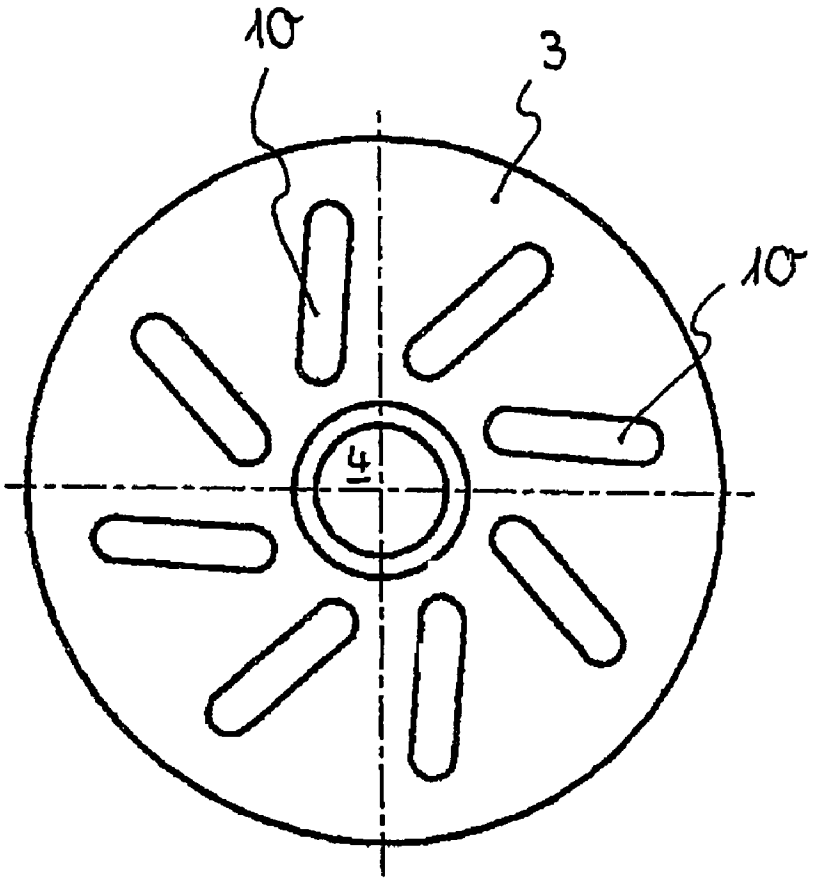

As shown in FIG. 3, the support ribs 10 can have a straight longitudinal extent. In order to support the stiffening of the working diaphragm 3 in the non-deformable annular zone, it can be advantageous if the support ribs 10 deviate from the radial lines preferably by up to ±30°. However, it is also possible that the support ribs—as shown in FIG. 4—have a curved longitudinal extent and are arranged practically in a spiral on the lower side of the diaphragm.

Figure 4:
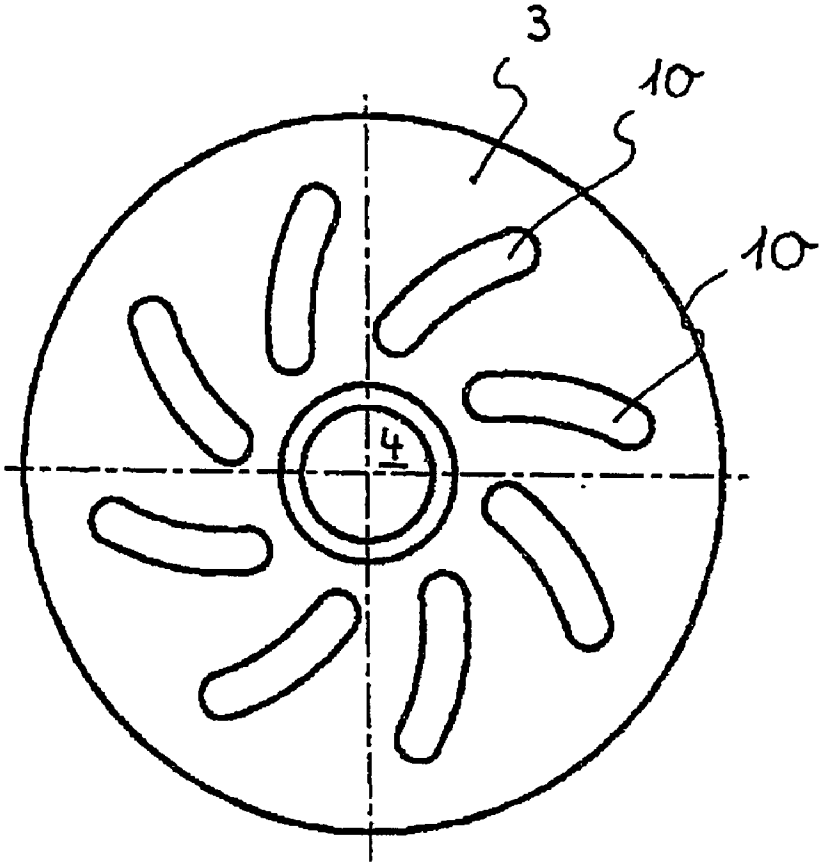

The greater the angle of the support ribs 10 shown in FIGS. 3 and 4 to the radial lines, the smaller the radial deformation of the support ribs 10 and the deformation of the contours of the support ribs 10 facing the compression or pump chamber 7, which is associated with an increase in the dead space, as well as with a reduction of the final vacuum.

The invention claimed is:

1. Diaphragm pump (1) comprising a working diaphragm (3), which, during pumping movements, oscillates between a bottom dead center and a top dead center, which delimits a pump chamber (7) between the working diaphragm and a pump chamber wall (6), and which rests against the pump chamber wall (6) in the top dead center, the working diaphragm (3) has an inner and an outer annular zone (8, 9), which are deformable during the pumping movements, a stiffened diaphragm area that is generally non-deformable during the pumping movements is arranged between the deformable annular zones (8, 9), and the working diaphragm (3) is stiffened in the stiffened diaphragm area by support ribs (10), which are oriented in a radial direction and are spaced apart from each other in a circumferential direction, and which are arranged on a lower side of the diaphragm facing away from the pump chamber wall (6).

2. Diaphragm pump according to claim 1, wherein the pump chamber wall is concave.

3. Diaphragm pump according to claim 1, the support ribs (10) have a straight longitudinal extent.

4. Diaphragm pump according to claim 1, wherein the support ribs (10) are spaced apart from each other in a circumferential direction and have a same direction of curvature or deviation from radial lines.

5. Diaphragm pump according to claim 1, wherein a side of the support ribs (10) facing the pump chamber wall (6) is adapted in shape to a contour of the pump chamber wall (6).

6. Diaphragm pump comprising a working diaphragm (3), which, during pumping movements, oscillates between a bottom dead center and a top dead center, which delimits a pump chamber (7) between the working diaphragm and a pump chamber wall (6), and which rests against the pump chamber wall (6) in the top dead center, the working diaphragm (3) has an inner and an outer annular zone (8, 9), which are deformable during the pumping movements, a stiffened diaphragm area that is generally non-deformable during the pumping movements is arranged between the annular zones (8, 9), and the working diaphragm (3) is stiffened in the stiffened diaphragm area by support ribs (10), which are oriented in a radial direction and are spaced apart from each other in a circumferential direction, and which are arranged on a lower side of the diaphragm facing away from the pump chamber wall (6), wherein the support ribs (10) have a curved longitudinal extent.

7. Diaphragm pump comprising a working diaphragm (3), which, during pumping movements, oscillates between a bottom dead center and a top dead center, which delimits a pump chamber (7) between the working diaphragm and a pump chamber wall (6), and which rests against the pump chamber wall (6) in the top dead center, the working diaphragm (3) has an inner and an outer annular zone (8, 9), which are deformable during the pumping movements, a stiffened diaphragm area that is generally non-deformable during the pumping movements is arranged between the annular zones (8, 9), and the working diaphragm (3) is stiffened in the stiffened diaphragm area by support ribs (10), which are oriented in a radial direction and are spaced apart from each other in a circumferential direction, and which are arranged on a lower side of the diaphragm facing away from the pump chamber wall (6), wherein the support ribs (10) deviate from radial lines.

8. Diaphragm pump according to claim 7, wherein the deviation is up to about plus or minus 30°.

* * * * *